United States Patent [19]

Vetter

[11] Patent Number: 4,625,461

[45] Date of Patent: Dec. 2, 1986

[54] METHOD AND APPARATUS FOR POSITIONING WORK SUPPORTING UNITS IN GRINDING MACHINES

[75] Inventor: Ulrich Vetter, Stuttgart, Fed. Rep. of Germany

[73] Assignee: Schaudt Maschinenbau GmbH, Stuttgart, Fed. Rep. of Germany

[21] Appl. No.: 690,129

[22] Filed: Jan. 10, 1985

[30] Foreign Application Priority Data

Jan. 13, 1984 [DE] Fed. Rep. of Germany ..... 3401088

[51] Int. Cl.[4] ..... B24B 49/00

[52] U.S. Cl. ..... 51/165.77; 51/72 L; 51/105 SP; 409/209; 409/241; 82/31

[58] Field of Search ..... 51/105 SP, 72 L, 165 R, 51/165.74, 165.75, 165.76, 165.77, 240 R; 409/209, 241; 82/31

[56] References Cited

U.S. PATENT DOCUMENTS 917,389 4/1909 Wendell ..... 82/31

2,559,431 7/1951 Hollengreen ..... 51/105 SP 2,639,562 5/1953 Balsiger ..... 51/105 SP 3,763,600 10/1973 Shank ..... 51/105 SP

*Primary Examiner*—Harold D. Whitehead

*Attorney, Agent, or Firm*—Peter K. Kontler

[57] ABSTRACT

The work supporting unit or units on the stationary or reciprocable work supporting table of a plain grinding machine are adjustable with reference to the table by one of the existing numerically controlled drives, such as the drive which reciprocates the table with reference to a stationary base or the drive which reciprocates a carriage for the grinding wheel relative to a stationary table. The locking device or devices which normally fix the adjustable unit or units to the table are disengaged and the unit or units are separably coupled to the reciprocable part (table or carriage) by suitable detents which can be engaged or disengaged by numerically controlled drives or by an existing drive such as the drive for a slide which is reciprocably mounted on the reciprocable carriage and supports the grinding wheel.

13 Claims, 3 Drawing Figures

METHOD AND APPARATUS FOR POSITIONING WORK SUPPORTING UNITS IN GRINDING MACHINES

BACKGROUND OF THE INVENTION

The present invention relates to grinding machines or analogous machine tools in general, and more particularly to improvements in grinding machines of the type wherein one or more units (such as the headstock or the tailstock for the workpiece, a dressing tool or a measuring device) must be adjusted with reference to the work supporting table when the machine tool is to be converted from the treatment of a first batch of workpieces to the treatment of a second batch of different workpieces. The invention also relates to a method of converting a grinding machine or an analogous machine tool for the treatment of different types of workpieces.

It is customary to provide the work supporting table of a plain or rotary grinding machine with a first work supporting unit (e.g., a headstock) and a second work supporting unit (e.g., a tailstock). Each of these units comprises or can comprise a center for the respective axial end of a rotatable workpiece and one of the units is normally provided with a drive which rotates the workpiece during removal of material therefrom by one or more driven grinding wheels or analogous material removing tools. The table can also carry other types of work supporting units, e.g., one or more steady rests or the like. Furthermore, the table can carry one or more distance measuring devices (e.g., diameter measuring or monitoring gauges, gauges which are designed to monitor the distance between a shoulder on the workpiece and the grinding station and/or others). Still further, the table can support a dressing apparatus for the grinding wheel or wheels. All or at least some of these units must be adjusted with reference to the table before the machine is ready to proceed with the treatment of a fresh set of workpieces whose dimensions deviate from those of the previously treated workpieces. For example, it is necessary to shift at least one of the work supporting units relative to the table when the grinding machine is to treat a fresh series of workpieces which are longer or shorter than the previously treated workpieces. This will be readily appreciated by bearing in mind that each workpiece is normally held between a pair of centers and that the distance between the centers must be changed if a relatively short workpiece is to be followed by a relatively long workpiece or vice versa. As a rule, it is the headstock or the tailstock which must be shifted relative to the work supporting table before the grinding machine is ready to treat a series of different workpieces. Furthermore, it is often necessary to change the position or positions of one or more steady rests if the machine is equipped with such units.

If the grinding machine is a numerically controlled machine tool, it is evidently desirable and advantageous to carry out any and all changes of the setup in a fully automatic way, i.e., in response to signals from the controls of the machine. It is already known to provide a discrete drive for a unit which must be adjusted with reference to the work supporting table of the grinding machine before the latter is ready to treat a different set of workpieces, and to automatically actuate such drive in response to signals from the numerical control means. As a rule, a discrete drive is provided only for that unit or for those units which require frequent adjustments with reference to the table, particularly for the headstock or tailstock on the table. The provision of one or more discrete drives, operative connections between such drive or drives and the respective unit or units on the table, and operative connections between such drive or drives and the controls of the machine contributes significantly to the bulk, initial cost and maintenance cost of the machine. Moreover, each adjustable unit is normally associated with a position monitoring device whose location relative to the table must be changed whenever the position of the corresponding unit is changed. This is the reason that, as a rule, presently known grinding machines are provided with a numerically controlled drive for only one of the units which must be adjusted with reference to the work supporting table before the machine is ready to treat a different set of workpieces. All other units are adjusted by hand which is a time-consuming operation and adversely affects the output of the machine.

Another drawback of presently known grinding machines and analogous machine tools of the above outlined character is that the drive or drives for one or more adjustable units cannot be readily installed in or on existing machines. In fact, even the incorporation of such features in presently known types of grinding machines during the making and assembly of such machines presents serious problems and unduly increases their initial cost because the drives and their connections to the respective units and to the controls occupy too much space which is not readily available in presently known types of grinding and like machines.

OBJECTS AND SUMMARY OF THE INVENTION

An object of the invention is to provide a novel and improved method of rapidly converting a grinding or a like machine for the treatment of different types of workpieces.

Another object of the invention is to provide a method which can be practiced in conjunction with many existing types of machines without necessitating extensive and costly modifications and/or rebuilding.

A further object of the invention is to provide a grinding machine, such as a plain grinding machine, which can be rapidly converted for the treatment of different types of workpieces and wherein the conversion can be completed rapidly and at a low cost irrespective of whether it necessitates the adjustment of one or more work supporting and/or other units relative to the work supporting table.

An additional object of the invention is to provide a novel and improved method of carrying out rapid and inexpensive changes in the setup of a grinding machine when the treatment of a batch of first workpieces is to be followed by the treatment of a batch of different second workpieces, e.g., when the treatment of relatively short rotary workpieces is to be followed by the treatment of a series of longer workpieces.

Still another object of the invention is to provide a method of equipping grinding machines during their assembly with novel and improved as well as simple, inexpensive but highly effective means for completing the conversion of the machines for the treatment of different workpieces with little loss in time and with a high degree of precision.

A further object of the invention is to provide a grinding machine wherein the existing parts can perform additional functions so that the machine need not be equipped with additional parts for the performance of functions which, in heretofore known machines, had to be carried out by parts that are not capable of performing any other tasks.

One feature of the invention resides in the provision of a method of selecting the mutual positions of at least one work supporting unit or an analogous unit (e.g., a distance measuring element or a dressing apparatus) in a machine tool (particularly in a plain grinding machine) and a work supporting table to which the one unit is normally locked and wherein the mutual positions of the table and a component of the machine tool other than the one unit (such component can constitute, for example, a stationary base or a reciprocable carriage which is mounted on the base) can be changed by a drive which receives actuating impulses from the automatic controls (e.g., numerical controls) of the machine tool. The method comprises the steps of unlocking the one unit from the table, coupling the one unit to the aforementioned component of the machine tool, causing the automatic controls of the machine tool to effect a change in the positions of the one unit and the component on the one hand and the table on the other hand relative to each other until the one unit and the table assume a selected position with reference to one another, and locking the one unit to the table. Such method preferably further comprises the step of uncoupling the one unit from the aforementioned component of the machine tool upon completion of the change in the positions of the one unit and the aforementioned component on the one hand and the table on the other hand relative to each other.

If the method is carried out in a grinding machine wherein a grinding wheel or an analogous tool (e.g., a lapping tool) is rotatable about a predetermined axis, the aforementioned change in the positions of the one unit and the component on the one hand and the table on the other hand preferably takes place in the axial direction of the rotary tool.

The aforementioned causing step can include moving the one unit and the aforementioned component with reference to the table or moving the table with reference to the one unit and the component.

If the grinding machine comprises several work supporting and/or analogous units each of which must be adjusted with reference to the table and/or vice versa and each of which is locked to the table when the machine is ready for or is in actual use, the unlocking step comprises unlocking the units from the table (either simultaneously or one after the other), the coupling step then comprises coupling a thus unlocked unit to the aforementioned component (e.g., to the base) of the machine tool, the causing step includes causing the automatic controls of the machine tool to effect a change in the positions of the component and the unit which is coupled thereto on the one hand and the table on the other hand relative to each other until the unit which is coupled to the component and the table assume a selected position relative to each other (such selected position can be different for each unit), and the locking step then comprises locking to the table each unit which is located in the selected position with reference to the table.

Another feature of the invention resides in the provision of a machine tool (particularly a plain grinding machine) which comprises work supporting table means, second means which constitutes a component (e.g., the base or a carriage) of the machine tool, a drive for moving one of the two means relative to the other of these means, automatic (e.g., numerical) controls for operating the drive, a structure which includes at least one work supporting or an analogous unit (such as a headstock, a tailstock, a distance measuring device or a dressing apparatus), a locking device which is engageable to affix the one unit to the table means, and a coupling device which is operable to releasably connect the one unit to the second means so that the drive can place the one unit and the table means into any one of a plurality of selected positions with reference to each other in response to disengagement of the locking device and on coupling of the one unit to the second means. Thus, the drive which is provided for the one means (e.g., for the table or for the aforementioned carriage) can be used as a means for placing the table and the one unit into any one of a plurality of selected positions relative to each other.

The second means (e.g., the base of the machine tool) can be stationary and the drive means is then arranged to move the table means with reference to the second means. Alternatively, the table means can be stationary and the drive means is then arranged to move the second means (such as the aforementioned carriage which can reciprocate the grinding wheel) relative to the stationary table means.

The coupling device can include a detent comprising a first detent member provided on the one unit and a preferably complementary second detent member provided on the second means. The controls of the machine tool then preferably further include means (such as a rack and pinion drive or the like) for moving one of the detent members into and out of engagement with the other of the detent members. If the one means comprises or carries a slide (e.g., a slide mounted on the aforementioned carriage and serving to support the grinding wheel), the second detent member can be provided on the slide. This saves the aforementioned rack and pinion drive or the like because the second detent member can be moved into and from engagement with the first detent member by the customary drive which is provided to reciprocate the slide and the grinding wheel thereon relative to the carriage. The drive for the slide is preferably designed to reciprocate the latter in directions at right angles to the axis of rotation of the grinding wheel.

If the second means is stationary (e.g., if such second means constitutes or forms part of or is connected to the base of the machine tool), the one unit can be provided with a marker or index and the machine tool then preferably further comprises a sensor for the marker. The sensor is preferably provided on the second means and serves to generate a signal in response to movement of the marker to a predetermined position with reference thereto. If the aforementioned structure includes a plurality of units which are movably mounted on the table means and each of which includes a discrete marker, the locking device preferably includes a plurality of locks each of which is engageable to secure a different unit to the table means and the coupling device comprises a plurality of couplings each of which is arranged to couple a different unit to the table means. Such machine tool can further comprise a sensor for the markers and the sensor is preferably provided on the second means and serves to generate a different signal in response to movement of each of the markers to a predetermined position with reference thereto (each such predetermined position can be different from the other predetermined positions). The just mentioned sensor can comprise a plurality of switches, one for each of the markers and each being actuatable by the marker of a different unit. Each coupling is preferably designed to separably connect the corresponding unit to the second means in the predetermined position of the corresponding unit and the table means relative to each other.

The one unit can constitute a headstock or a tailstock with a center for the workpiece.

The novel features which are considered as characteristic of the invention are set forth in particular in the appended claims. The improved machine tool itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
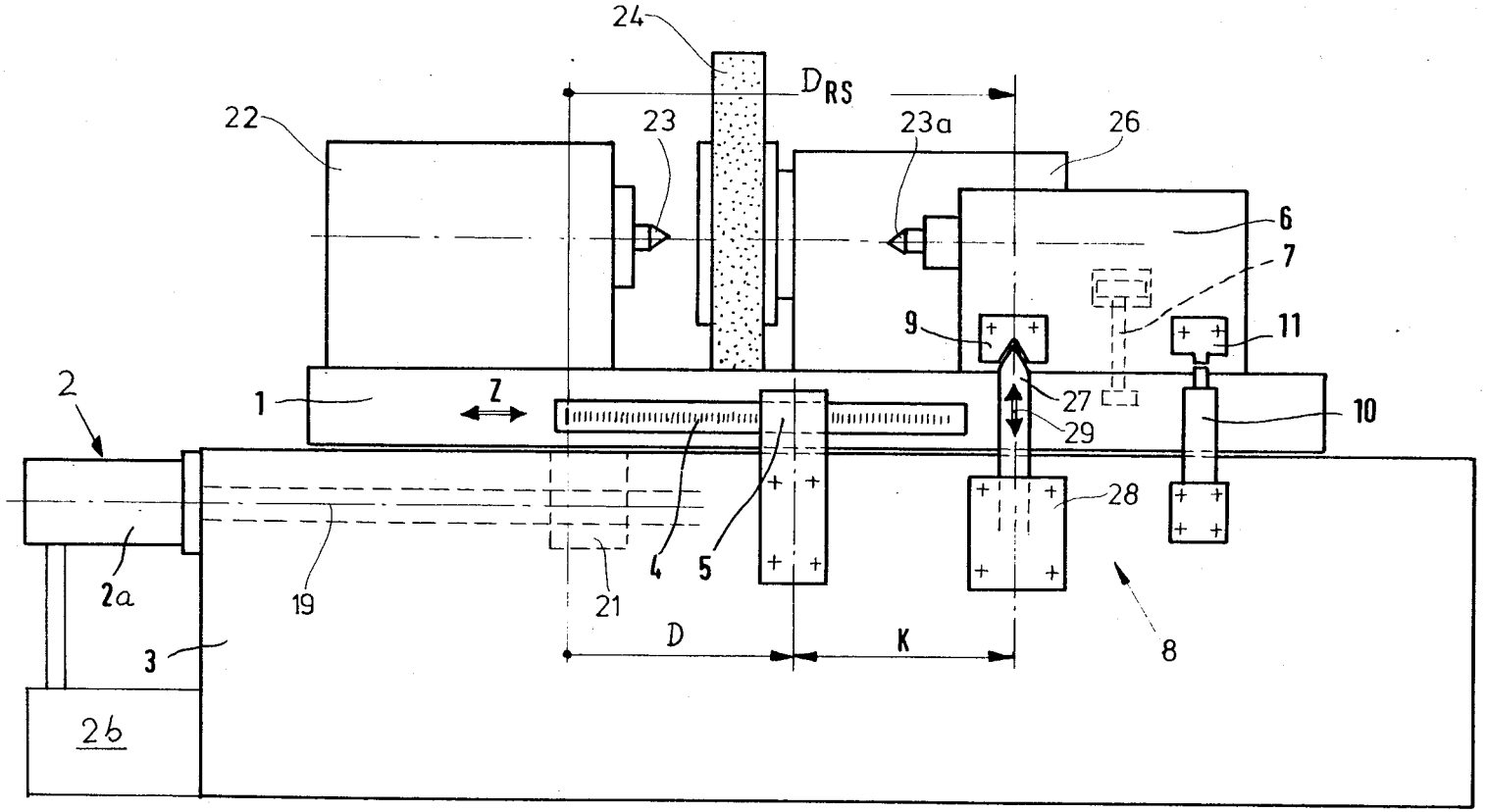
FIG. 1 is a schematic front elevational view of a plain grinding machine which embodies one form of the invention and wherein a work supporting unit is releasably coupled to the work supporting table which is reciprocable relative to the base of the machine.

Referring first to FIG. 1, there is shown a numerically controlled plain or circular grinding machine which comprises a stationary component (second means) or base 3 and a work supporting table 1 which is reciprocable on the base 3 in directions indicated by the double-headed arrow Z (i.e., in the axial direction of the grinding wheel 24) by a drive 2 including an elongated feed screw 19, a nut 21 which is provided at the underside of the table 1 and meshes with the feed screw 19, and a reversible electric motor 2*a* which receives operating impulses from the automatic machine controls 2*b*. The table 1 carries a suitably graduated elongated scale 4 which is monitored by a scanning device 5 serving to transmit to the controls 2*b* signals denoting the momentary position of the table 1 with reference to the base 3.

The table 1 further supports a work supporting unit here shown as a headstock 6 which is shiftable with reference thereto in the directions indicated by the arrow Z. An automatic locking device 7 is provided to normally lock the headstock 6 to the table 1. Such locking devices are well known in the art and, therefore, the exact construction of the illustrated locking device 7 and the manner in which it is operable by the controls 2*b* form no part of the present invention. The table 1 can further carry one or more additional work supporting or analogous (e.g., angular or other distance measuring or grinding wheel dressing) units which have been omitted in FIG. 1 for the sake of clarity.

In the embodiment of FIG. 1, the table 1 further carries a tailstock 22 having a center 23 which is in line with the center 23*a* of the headstock 6. A rotatory workpiece (not shown) can be mounted between the centers 23 and 23*a* and set in rotary motion to be treated by the working surface of the grinding wheel 24 which is mounted on a carriage 26. The latter is movable with reference to the table 1 at right angles to the plane of FIG. 1 so that the grinding wheel 24 can penetrate into the material of or can move radially and away from the workpiece between the centers 23 and 23*a*. The manner in which the workpiece between the headstock 6 and the tailstock 22 is rotated (if a rotation of the workpiece is necessary) forms no part of the present invention.

The base 3 carries one detent member of a coupling device 8 which can separably connect the headstock 6 with the base so that the table 1, its scale 4 and the tailstock 22 can move relative to the base and relative to the headstock when the locking device 7 is deactivated or disengaged and the motor 2*a* is caused to rotate the feed screw 19 in a clockwise or in a counterclockwise direction, depending upon whether the tailstock 22 is to be moved nearer to or further away from the headstock 6. The first detent member of the coupling device 8 comprises a locking bolt 27 which is reciprocable in directions indicated by a double-headed arrow 29 by a drive 28 which receives operating impulses from the controls 2*b*. The second detent member 9 of the coupling device 8 includes a socket and is detachably, adjustably or permanently affixed to the front side of the headstock 6. Its socket can receive the pointed tip of the male detent member 27 when the latter is caused to move upwardly and to assume the position which is shown in FIG. 1. The position of the male detent member 27 and its drive 28 (as considered in the axial direction of the grinding wheel 24) is fixed, i.e., the distance K between the central plane of the male detent member 27 and the central plane of the scanning device 5 is a constant. Thus, the distance between the centers 23 and 23*a* can be ascertained by the simple expedient of reading the position of the scale 4 with reference to the scanning device 5. All that is necessary is to operate the drive 2 until the scanning device 5 detects a selected graduation of the scale 4. At such time, the table 1 is held in a predetermined position with reference to the base 3 and to the male detent member 27 of the coupling device 8. Such adjustability of the table 1 relative to the base 3 and headstock 6 (while the locking device 7 is inoperative and the coupling device 8 connects the headstock 6 to the base 3) renders it possible to ensure that the grinding wheel 24 removes material from an accurately selected portion of the workpiece which is held between the centers 23 and 23*a*.

As mentioned above, FIG. 1 shows the coupling device 8 in the operative position, i.e., the tip of the male detent member 27 extends into the socket of the female detent member 9 on the headstock 6. The clamping or locking device 7 is inoperative so that the table 1 can be shifted in the directions which are indicated by the arrow Z in response to starting of the motor 2*a*, i.e., in response to a signal from the controls 2*b*. The scanning device 5 monitors the positions of the scale 4 and table 1 with reference thereto and transmits appropriate signals to the controls 2*b*. In order to place the zero graduation of the scale 4 at a predetermined distance $D_{RS}$ with reference to the tip of the male detent member 27 of the coupling device 8, it is only necessary to arrest the motor 2*a* of the drive 2 when the distance between the zero graduation of the scale 4 and the central plane of the scanning device 5 equals D. Such mode of transmitting signals to the controls 2b and of evaluating the thus transmitted signals need not deviate from the mode of transmitting signals to the controls when the grinding machine is in actual use, i.e., when the grinding wheel 24 is in the process of removing material from the workpiece which is held between the centers 23 and 23a.

The grinding machine of FIG. 1 further comprises a sensor 10 which is fixedly or adjustably mounted on the base 3, and the headstock 6 carries a marker or index 11 which can cause the sensor 10 to transmit to the controls 2b a signal whenever the marker 11 assumes a predetermined position relative thereto. In the illustrated embodiment, the sensor 10 a signal to the controls 2b whenever the tip of the male detent member 27 is in exact register with the socket of the female detent member 9. The sensor 10 can constitute a proximity switch and the marker 11 can constitute an electromagnet or a permanent magnet which causes the proximity switch to complete a circuit and to thereby transmit to the controls 2b a signal as soon as the headstock 6 assumes the illustrated position with reference to the base 3. This enables the controls 2b to transmit a signal to the drive 28 so that the latter lifts the male detent member 27 and causes its tip to penetrate into the female detent member 9. For example, the controls 2b can be designed to cause the drive 2 to automatically move the table 1 (with the headstock 6 attached to the table by the locking device 7) relative to the base 3 until the sensor 10 transmits a signal denoting that the members 27 and 9 of the coupling device 8 are in proper positions relative to each other for actuation of the drive 28 (so as to lift the male detent member 27 to the illustrated position) and for deactivation of the locking device 7 so that the headstock 6 is then properly connected to the base 3 and the table 1 is free to move relative to the base 3 and headstock 6 in response to starting of the motor 2a. An advantage of the sensor 10 and marker 11 is that the memory of the controls 2b need not store information pertaining to the illustrated position of the female detent member 9 with reference to the male detent member 27.

An important advantage of the improved grinding machine is that the drive 2 which is provided for the purpose of moving the table 1 relative to the base 3 can also perform another important and useful function, namely of facilitating rapid and numerically controlled adjustment of the headstock 6 with reference to the table 1 whenever the need arises, i.e., whenever the treatment of a first set of workpieces is to be followed by the treatment of a set of different second workpieces. Thus, the improved machine tool need not be equipped with a separate drive for the headstock 6, with a separate operative connection between such drive and the headstock and/or with an operative connection between the separate drive and the controls 2b. This contributes significantly to a reduction of the initial and maintenance cost as well as to compactness of the machine. All that is necessary is to provide the coupling device 8 and, if desired, the marker 11 and sensor 10. The remaining parts (such as the locking device 7, the scale 4 and the scanning device 5) can constitute conventional parts. The same applies for the drive 2 and the controls 2b. The provision of a drive 28 which receives signals from the controls 2b is desirable and advantageous because this contributes to the accuracy of adjustment of the headstock 6 as well as to a shortening of the interval of time which is required for carrying out a change in setup.

Figure 3:
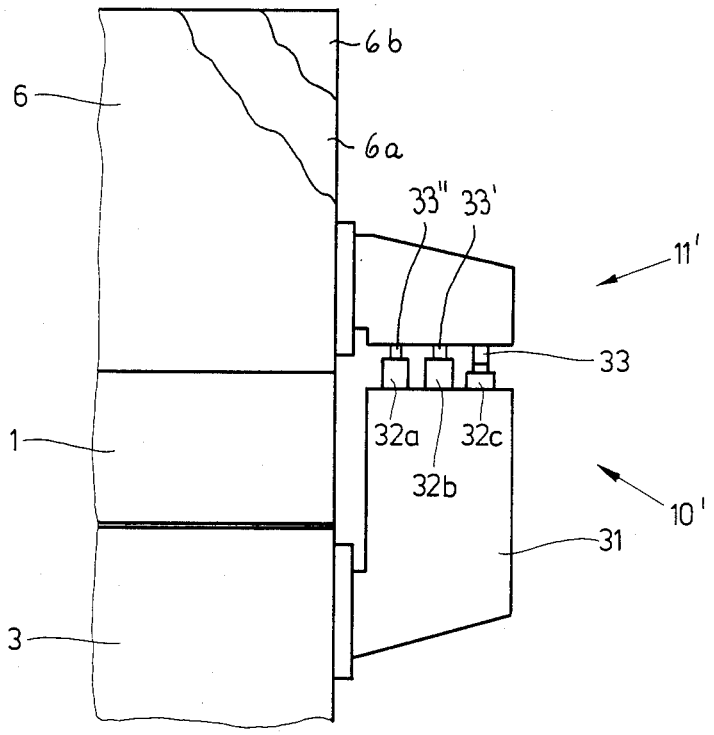
FIG. 3 is a fragmentary end elevational view of a third grinding machine which constitutes a modification of the grinding machine of FIG. 1 and wherein the table supports several units which are adjustable with reference thereto.

The grinding machine of FIG. 1 can be equipped with a modified sensor if the table 1 supports two or more units (such as the illustrated headstock 6 and one or more distance measuring units and/or a dressing apparatus for the grinding wheel 24) each of which should be adjusted with reference to the table when the machine is to be converted for the treatment of a series of different workpieces and/or for other reasons. This is shown schematically in FIG. 3 wherein the sensor 10' comprises a series of discrete sensors (e.g., proximity switches) 32a, 32b, 32c mounted on a bracket 31 which is secured to the base 3. The headstock 6 carries a first marker 33 which forms part of a composite marker 11' and can cause the sensor or proximity switch 32c to generate a signal when the female detent member 9 (not shown in FIG. 3) on the headstock 6 assumes a predetermined position with reference to the associated male detent member 27 on the base 3. Analogously, the sensor or proximity switch 32b can generate a signal (which is transmitted to the controls of the grinding machine) when a second unit 6a (e.g., a unit for measuring the diameter of the workpiece) assumes a predetermined position with reference to the base 3 (the marker of the unit 6a is shown at 33'). The sensor or proximity switch 32a can generate a signal when it is approached by the marker 33'' on a third unit 6b which is provided on the table 1 and can constitute, for example, a dressing apparatus for the grinding wheel or wheels on the table 1. It is clear that each of the units 6, 6a, 6b can be secured to the table 1 by a discrete locking device and that the machine tool which embodies the structure of FIG. 3 comprises a discrete coupling device (detent means) for each of the units 6, 6a and 6b. Each of the markers 33, 33', 33'' is coded differently so that it can cause only the corresponding sensor 32c, 32b or 32a to generate a signal in a predetermined position of the corresponding unit 6, 6a or 6b with reference to the table 1. In the embodiment of FIG. 3, the different codes are the different positions of the markers 33, 33' and 33'' relative to each other. It is clear, however, that the illustrated sensor 10' and the illustrated composite marker 11' including the markers 33, 33', 33' can be replaced with electronic signal generating means or any other means which can adequately apprise the controls 2b of the positions of the respective units 6, 6a, 6b relative to the table 1 and base 3. All that counts and all that is actually desired in the embodiment of FIG. 3 is to provide a sensor 10' or an equivalent sensor and a set of discrete markers (one for each of the adjustable units 6, 6a, 6b) which can discriminate between the positions of the three units 6-6b relative to the base 3 and can transmit appropriate signals to the controls 2b for evaluation, e.g., for timely actuation of the drives for the corresponding mobile detent members.

In order to convert the machine of FIG. 3 for the treatment of a different series of workpieces, it is merely necessary to cause the table 1 to perform a dry run, i.e., to simply move relative to the base 3 until the marker 33 causes the switch 32c to generate a signal (this initiates a deactivation of the locking device 7 and the actuation of the drive 28 to connect the male detent member 27 with the female detent member 9), until the marker 33' causes the switch 32b to generate a signal (in order to separably couple the unit 6a to the table 1) and until the marker 33'' causes the switch 32a to generate a signal (which ensures that the unit 6b is adequately coupled to the base 3).

The provision of the sensor 10 or 10' and the associated marker 11 or 11' is optional but desirable and advantageous because the numerical controls need not memorize certain positions of the table 1, such as the position of FIG. 1 in which the detent members 9 and 27 are accurately aligned with each other or any of the three positions of the table 1 of FIG. 3 wherein the switches 32c, 32b, 32a are respectively aligned with the markers 33, 33' and 33''. The provision of a memory which memorizes the position of a single adjustable unit (such as the headstock 6 of FIG. 1) is often preferred to the provision of a sensor and a marker because it does not contribute significantly to the overall cost of the controls 2b and of the entire machine. However, the provision of a sensor (10') and a discrete marker (33, 33', 33'') for each unit is preferred when the table 1 carries two, three or more adjustable units so that the controls 2b would have to be equipped with a rather complex memory. Moreover, the structure of FIG. 3 is less likely to allow for improper adjustment of the unit 6, 6' and/or 6'', even if the paths of movement of these units to new positions preparatory to the treatment of a different batch of workpieces slightly or substantially overlap each other. Thus, the structure of FIG. 3 ensures, in a simple but efficient manner, that the adjustments of various units cannot be affected by errors in programming, and such independence is practically total if the sensor and the markers are constructed and cooperate in a manner as described in connection with FIG. 3.

Figure 2:
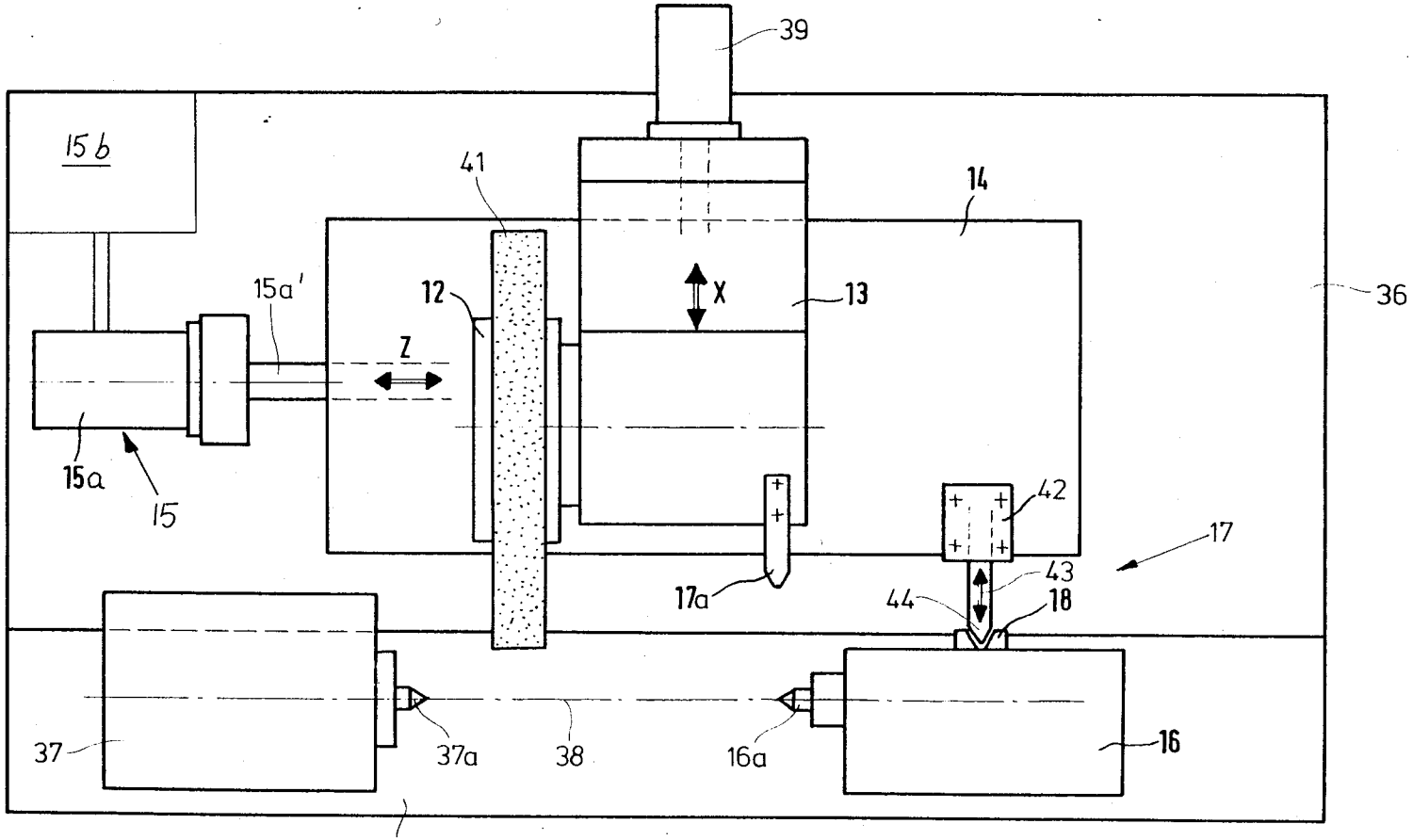
FIG. 2 is a schematic plan view of a second grinding machine wherein a carriage which supports the grinding wheel is reciprocable with reference to a stationary work supporting table, the locking device between the work supporting unit and the table being disengaged and such unit being coupled to the carriage.

FIG. 2 shows a modified plain grinding machine wherein the work supporting table 34 is stationary in that it is fixedly connected to the base 36. The second means of the grinding machine is a carriage 14 which is reciprocable with reference to the base 36 in directions indicated by the double-headed arrow Z, i.e., in the axial direction of the grinding wheel 41. The drive 15 for moving the carriage 14 relative to the table 34 comprises a reversible motor 15a, a feed screw 15a' which can be rotated by the motor 15a, and a nut (not shown) which is mounted on the carriage 14 and meshes with the feed screw 15a'. The motor 15a receives signals from the controls 15b. The table 34 supports a headstock 16 which is separably locked thereto by a device (not shown) corresponding to the locking device 7 of FIG. 1 and which further carries the female detent member 18 of a coupling device 17 further including a male detent member 44 and a motor or drive 42 serving to reciprocate the male detent member 44 in the directions indicated by the double-headed arrow 43 in response to signals from the controls 15b. The table 34 further supports a fixedly or adjustably mounted tailstock 37 having a center 37a. A workpiece can be held between the center 37a of the tailstock 37 and the center 16a of the adjustable headstock 16. The common axis of the centers 37a and 16a is shown at 38; this axis is parallel to the axis of the grinding wheel 41. The means for rotating the workpiece about the axis 38 is mounted in or on the tailstock 37 but is not specifically shown in FIG. 2. It suffices to say that the workpiece between the centers 16a and 37a is or can be rotated when the grinding wheel 41 is in the process of removing material therefrom.

The carriage 14 supports a cross slide 13 which is reciprocable thereon in directions indicated by a double-headed arrow X, namely at right angles to the axis of the grinding wheel 41. The spindle 12 for the grinding wheel 41 is rotatably mounted in or on the cross slide 13 and is driven to rotate the grinding wheel at an elevated speed when the machine is in actual use. The reference character 39 denotes a further drive which receives impulses from the controls 15b and serves to move the cross slide 13 in the directions which are indicated by the double-headed arrow X. It will be noted that, in the machine of FIG. 2, the movements which are needed to shift the grinding wheel 41 axially (i.e., in parallelism with the axis of the workpiece between the centers 16a and 37a) are effected by starting the motor 15a which then moves the carriage 14 in the directions indicated by the double-headed arrow Z. Feed movements of the grinding wheel 41 in the radial direction of the workpiece between the centers 16a and 37a are effected by starting the motor 39 so as to move the cross slide 13 relative to the carriage 14. Thus, the carriage 14 and the motor 15a perform the functions of the table 1 and motor 2a in the grinding machine of FIG. 1.

When the position of the headstock 16 with reference to the tailstock 37 is to be changed, the locking device between the table 34 and the headstock 16 is disengaged and the motor 15a is caused to move the carriage 14 to the illustrated position in which the tip of the male detent member 44 is in register with the socket of the female detent member 18. The controls 15b then transmit a signal to the drive 42 which engages the male detent member 44 with the female detent member 18 so that the headstock 16 is thereupon compelled to share the movements of the carriage 14 in directions which are indicated by the arrow Z. Thus, the motor 15a can move the carriage 14 and the grinding wheel 41 in parallelism with the axis of the workpiece between the centers 16a, 37a and this motor can also serve as a means for changing the position of the headstock 16 with reference to the tailstock 37 so as to allow for the treatment of different workpieces. The locking device between the headstock 16 and the table 34 is automatically deactivated in response to a signal from the controls 15b not later than when the tip of the male detent member 44 is caused to penetrate into the socket of the female detent member 18 in response to a signal from the controls 15b to the drive 42. Once the headstock 16 has been moved to one of a number of different possible positions (i.e., to a selected position), the detent member 44 is extracted from the socket of the detent member 18 and the locking device between the headstock 16 and the table 34 is activated so that the headstock is positively held in the newly selected position.

The parts 42 and 44 of the coupling device 17 can be omitted if the cross slide 13 on the carriage 14 is provided with a male detent member 17a which can penetrate into the socket of the female detent member 18 on the headstock 16. The drive 42 is then unnecessary because its function can be performed by the drive 39 for the cross slide 13 i.e., by the drive which serves to move the grinding wheel 41 at right angles to its axis. The locking device between the headstock 16 and the table 34 is then preferably deactivated when the carriage 14 moves the male detent member 17a to a position of substantial register with the socket of the female detent member 18 so that, when the motor 39 is thereupon started to move the cross slide 13 toward the table 34, the tip of the male detent member 17a automatically finds its way into the socket of the female detent member 18 and thus ensures that the headstock 16 is properly coupled to the carriage 14.

The construction of the machine of FIG. 2 can be simplified (and its initial and maintenance cost reduced) considerably if the coupling 17 is replaced with the much simpler coupling including the male detent member 17*a* on the carriage 13 and the female detent member 18 on the headstock 16. This obviates the need for the reciprocable detent member 44 and for the drive 43 as well as for the connection between such drive and the controls 15*b*. Thus, the drive 39 (which is required anyway) performs the function of the drive 42. It is clear that the positions of the male and female detent members can be reversed, not only in the machine of FIG. 2 but also in the machine of FIGS. 1 or 3.

The feature of FIG. 2, namely that the drive 39 can replace the drive 42, can be used with equal or similar advantage in the embodiment of FIG. 1 if the part 26 is mounted on a slide corresponding to the slide 13 of FIG. 2 and such slide is reciprocable by a drive corresponding to the drive 39 of FIG. 2.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of selecting the mutual positions of at least one work supporting unit in a grinding machine and a work supporting table to which the unit is normally locked and wherein the mutual positions of the table and a machine part other than said at least one unit can be changed by a drive which receives actuating impulses from the automatic controls of the machine to change said mutual positions in the direction of one machine axis, comprising the steps of unlocking the unit from the table; coupling the unit to the machine part; causing the automatic controls of the machine to move the table with reference to the unit and the machine part so as to effect a change in the positions of the unit and the machine part on the one hand and the table on the other hand relative to each other until the unit and the table assume a selected position with reference to one another; and locking the unit to the table.

2. The method of claim 1, further comprising the step of uncoupling the unit from the machine part upon completion of said change in the positions of the unit and the machine part on the one hand and the table on the other hand relative to each other.

3. The method of claim 1, wherein said causing step includes moving the unit and the machine part with reference to the table.

4. The method of claim 1 of changing the mutual positions of several units and a work supporting table with reference to each other in a grinding machine wherein the units are normally locked to the table, wherein said unlocking step comprises unlocking the units from the table, wherein said coupling step comprises coupling a thus unlocked unit to the machine part, wherein said causing step includes causing the automatic controls of the machine to effect a change in the positions of the machine part and the unit which is coupled thereto on the one hand and the table on the other hand relative to each other by moving the table until the unit which is coupled to the machine part and the table assume a selected position with reference to each other, and wherein said locking step incudes locking such unit to the table.

5. A grinding machine, comprising work supporting table means; second supporting means; a drive for moving said table means relative to said second supporting means in the direction of one machine axis; automatic controls for operating said drive; at least one work supporting unit; a locking device engageable to affix said unit to said table means; and a coupling device operable to releasably connect said unit to said second supporting means so that said drive can place said unit and said table means into any one of a plurality of selected positions with reference to each other in response to disengagement of said locking device and on coupling of said unit to said second supporting means.

6. The machine of claim 5, wherein said coupling device comprises a detent including a first detent member provided on said unit and a complementary second detent member provided on said table means, said controls including means for moving one of said detent members into and out of engagement with the other of said detent members.

7. The machine of claim 5, wherein said second supporting means is stationary and said one unit includes a marker, and further comprising a sensor for said marker, said sensor being provided on said second supporting means and being arranged to generate a signal in response to movement of the marker to a predetermined position with reference thereto.

8. The machine tool of claim 5, wherein said coupling device is operable to releasably connect said unit to said second supporting means in said predetermined position of said marker with reference to said sensor.

9. The machine of claim 5, wherein said second supporting means is stationary, said includes a plurality of units movably mounted on said table means and each including a discrete marker, said locking device including a plurality of locks each engageable to secure a different one of said units to said table and said coupling device including a plurality of couplings each arranged to couple a different one of said units to said second supporting means, and further comprising a sensor for said markers, said sensor being provided on said second supporting means and being arranged to generate a different signal in response to movement of each of said markers to a predetermined position with respect thereto.

10. The machine of claim 9, wherein said sensor comprises a plurality of switches, one for each of said markers and each actuatable by the marker of a different one of said units.

11. The machine of claim 5, wherein said one unit includes a center for a rotary workpiece.

12. The machine of claim 5, wherein said second means includes a stationary base and said table means is reciprocable with reference to said base.

13. The machine of claim 5, further comprising a grinding wheel which is mounted on said one means.

* * * * *